United States Patent [19]

Drexler et al.

[11] Patent Number: 4,717,899

[45] Date of Patent: Jan. 5, 1988

[54] CONTACTOR WITH ADDITIONAL SWITCHBLOCK

[75] Inventors: Johann Drexler, Schwandorf; Erwin Flierl, Kümmersbruck, both of Fed. Rep. of Germany

[73] Assignee: Siemens Aktiengesellschaft, Munich, Fed. Rep. of Germany

[21] Appl. No.: 40,240

[22] Filed: Apr. 20, 1987

[30] Foreign Application Priority Data

Apr. 23, 1986 [DE] Fed. Rep. of Germany ... 8611138[U]

[51] Int. Cl.[4] ..... H01H 67/02

[52] U.S. Cl. ..... 335/131; 335/13; 335/161; 335/197

[58] Field of Search ..... 335/13, 131, 132, 133, 335/161, 159, 197, 198, 278; 200/153 LA

[56] References Cited

U.S. PATENT DOCUMENTS 3,949,333 4/1976 Freitag et al. ..... 335/197
4,345,225 8/1982 Lemmer ..... 335/132
4,356,368 10/1982 Osika ..... 335/132

*Primary Examiner*—E. A. Goldberg
*Assistant Examiner*—Lincoln Donovan
*Attorney, Agent, or Firm*—Kenyon & Kenyon

[57] ABSTRACT

An additional switchblock is laterally connected to a contactor of a magnetic control relay. The terminals of the switchblock and contactor are provided for on the front side opposite that of the support bar. A hook connection is used between the two lateral surfaces. When the hooks formed on the additional switchblock are inserted into corresponding recesses in the contactor, a formed-on ring portion of the additional switchblock actuating element engages with a switch position indicator extending from the front side of the contactor so that the actuating coupling is assured. The detent preventing the additional switchblock from sliding back away from the contactor is accomplished via detent arms formed on the additional switchblock arms and having wedge shaped projections which engage recesses in the contactor cover.

4 Claims, 1 Drawing Figure

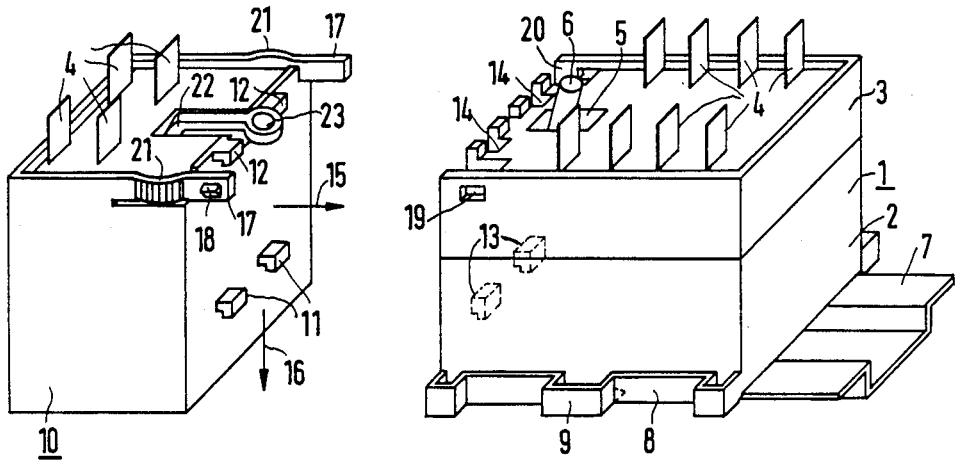
21
17
4
22
12
23
21
12
15
18
17
11
16
10
20
6
5
14
14
4
3
1
19
2
13
7
9
8

CONTACTOR WITH ADDITIONAL SWITCHBLOCK

BACKGROUND OF THE INVENTION

The present invention relates to a magnetic control relay, and more particularly to a magnetic control relay contactor unit having means for coupling an additional switchblock.

U.S. Pat. No. 3,548,349 issued to Fujita discloses a magnetic control relay including an operating electromagnet contained in a housing to which a variable number of contact housing units, each of which contains fixed contacts, movable contacts and an actuating element for these movable contacts are connected.

At the electromagnet housing unit hook connections are provided which can be inserted into matching connections at the contact housing transversely to the actuating direction of the contacts. Spring-loaded plungers in the contact housing units are detented in recesses formed in the electromagnet housing. The contact housing unit actuating element has a hammer head form with which corresponding arms of the actuating element connected to the movable magnet in the electromagnet housing engage. In this known arrangement, the terminals are provided for at the individual contact housing units. Only the terminals for the electromagnetic actuating coil are connected to the electromagnet housing.

SUMMARY OF THE INVENTION

The present invention improves upon the magnetic control relays of the prior art by allowing the simple addition and removal of additional contacts as a block unit from already integrated switch contacts.

The invention is particularly suited for contactors wherein the actuating direction of the contacts is parallel to the mounting plane. These objects are achieved in a contactor having the terminal elements for the already integrated switch contacts arranged on the front side opposite the mounting surface. Further, the additional switchblock is fastened to a side surface of the contactor which is transverse to the actuating direction of the contactor contacts. The form-locking connection of the additional switchblock consists of a ring-like formation extending around the switch position indicator which is coupled to operate the actuating element. The additional switchblock preferably has the same cross section as that of the contactor.

In order to dispense with the additional springs used as the means for detent in the prior art, it is a further advantage of the invention that the means for detent consist of resilient detent arms formed on the additional switchblock. Simple operation of the detent arms, especially when disengaging the additional switchblock, can be achieved by having part of the detent arms protrude beyond the outside contours of the additional switchblock. The need for compressing the detent arms during the addition of a switchblock is dispensed with by having the detent arms extend parallel to the actuating direction of the contactor. Wedge-shaped detent projections are located on the detent arms such that they engage recesses in the contactor to provide detent when the additional switchblock is connected to the contactor.

BRIEF DESCRIPTION OF THE DRAWING

The single FIGURE shows a side-elevational view of a switchblock and contactor in accordance with the present invention in an unassembled position.

DETAILED DESCRIPTION

Referring to the FIGURE, a magnetic control relay according to the present invention is shown.

The contactor or electromagnetic switchgear 1 consists of a lower housing part 2 and a cover part 3. A magnetic actuator, not specifically shown, is contained in the lower housing part 2. Located in the cover part 3 is the contact arrangement. The contact arrangement may include fixed flat plug contacts or terminals which can be connected via contact bridges, contact bridge carriers for the movable contact bridges, as well as a part having a switch position indicator 6 which is coupled to operate the actuating element 5. Actuation is carried out by moving switch position indicator in the direction of arrow 15. Attached to the lower housing part 2 for mounting the contactor on a support bar 7 are resilient elastic strips 8 fastened on opposite sides of the contactor and which provide for the connection of the lower housing part 2 with the support bar 7. These resilient strips are provided on both sides of the lower housing part 2 so that the contactor may be removed from both sides.

Hooks 11 and 12 serve to connect an additional switchblock 10 to the contactor 1. As an example, the hooks 11 and 12 are located at the four corners of a rectangle and protrude from a side wall of the switchblock housing 10. Both sets of hooks 11 and 12 have a portion parallel to the mounting plane, i.e., the support bar 7, and a portion facing the mounting plane, i.e. in the direction of arrow 16. The hooks 12 are formed at the upper edge of the side face of the switchblock 10. Corresponding to the hooks 11 and 12 are cooperating recesses 13 and 14 located in the contactor housing, respectively. The dashed lines in the lower part of the contactor housing 2 indicate the recesses 13 while the recesses 14 are located in the contactor cover part 3. Thus, motion in the direction of arrow 15 allows for the additional switchblock 10 to come into contact against the side surface of the contactor 1. Movement in the direction of arrow 16 allows the hooks to become operative, i.e., as the side surfaoe of the contactor 1 and the side surface of the switchblock 10 slide on each other.

Detent arms 17 are provided to prevent the switchblock 10 from sliding back away from the contactor 1. The detent arms 17 are formed on the additional switchblock housing and are readily resilient. Located at the free ends of the arms 17 are wedge-shaped detent projections 18 which snap-in behind the edge of a recess 19 located in the contactor 1 if the switchblock 10 is moved in the direction of arrow 16. The free end of the detent arms 17 rests against the inside wall 20 of the contactor cover part 3 when the additional switchblock is fully engaged. Therefore, tightening of the detent arms 17 when inserted is not necessary. Extensions 21 formed integrally with the detent arms 17 and which protrude beyond the outside contour of the switchblock 10 can be grabbed readily by the thumb and index finger serving to disengage the detent arms 17 from the recesses 19 of the contactor. Located on the front face opposite the mounting surface of both the switchblock 10 and the contactor 1 are flat plug terminals 4. A ring 23 is formed at one end of the switchblock actuating element 22 and is brought together in a form-locking manner with the switch position indicator 6 of the contactor 1 when the block 10 is inserted in the direction of arrow 16. This connection insures substantially play-free coupling between the actuating elements 5 and 22. Because the contactor 1 and the switchblock 10 have the same cross section, joining the two units produces a uniform equipment block. Separate mounting of the additional switchblock 10 to the support bar 7 is not necessary.

The present invention of a contactor 1 and switchblock 10 arrangement has been found advantageous in the field of home appliance circuit breakers.

What is claimed is:

1. A switching apparatus, comprising:

(a) a contactor having a first side adapted to be connected to a mounting surface, said contactor having a second side opposite said first side and a third side surface transverse to said first side;

(b) contacts integrally arranged inside said contactor, said contacts having an actuation direction parallel to said mounting surface;

(c) a contactor actuating element located in said contactor;

(d) a switch position indicator coupled to said contactor actuating element extending from said first side;

(e) terminals for said integral contacts disposed at said first side of said contactor;

(f) an additional switchblock containing additional contacts therein having a top surface and a side switchblock surface transverse to said top surface;

(g) means for coupling said side switchblock surface to said third side of said contactor including a plurality of hook connections and cooperating recesses located on said side switchblock surface and said third side respectively, said hook connections being inserted in said recesses transversely to said actuating direction;

(h) a switchblock actuating element for actuating said additional contact extending through said top surface, said switchblock actuating element surrounding said switch position indicator in a ring-like fashion and making a form locking connection at the second side of said contactor.

2. A switching apparatus according to claim 1 wherein said means for coupling further comprises resilient detent arms which are formed on said additional switchblock.

3. A switching apparatus according to claim 2 wherein:

(a) said detent arms extend parallel to said actuating direction of said contactor; and (b) a wedge-shaped detent projection is located on said detent arms to provide detent when said switchblock is coupled with said contactor.

4. A switching apparatus according to claim 3 wherein said detent arms have extensions which protrude beyond the outside contours of said additional switchblock.

* * * * *